US009814121B2

(12) United States Patent
Langdon, II

(10) Patent No.: US 9,814,121 B2
(45) Date of Patent: Nov. 7, 2017

(54) SEMI-WIRELESS ELECTRIC SWITCH SYSTEM

(71) Applicant: Richard L. Langdon, II, Lillington, NC (US)

(72) Inventor: Richard L. Langdon, II, Lillington, NC (US)

( * ) Notice: Subject to any disclaimer, the term of this patent is extended or adjusted under 35 U.S.C. 154(b) by 245 days.

(21) Appl. No.: 14/951,868

(22) Filed: Nov. 25, 2015

(65) Prior Publication Data

US 2016/0181036 A1 Jun. 23, 2016

Related U.S. Application Data

(63) Continuation of application No. 62/094,205, filed on Dec. 19, 2014.

(51) Int. Cl.
*H01H 47/22* (2006.01)
*H01H 47/32* (2006.01)
*H05B 37/02* (2006.01)

(52) U.S. Cl.
CPC ..... *H05B 37/0272* (2013.01); *H01H 47/325* (2013.01)

(58) Field of Classification Search
CPC ..... H01H 47/22; H01H 47/32; H01H 47/002; Y01T 307/74
USPC ..... 361/160
See application file for complete search history.

(56) References Cited

U.S. PATENT DOCUMENTS

| | | | | |
|---|---|---|---|---|
| 7,889,476 | B2 | 2/2011 | King | |
| 8,018,089 | B2 | 9/2011 | King | |
| 2010/0207548 | A1* | 8/2010 | Iott | H05B 37/0272 315/362 |
| 2011/0245940 | A1* | 10/2011 | Picco | H05B 37/0254 700/90 |

* cited by examiner

*Primary Examiner* — Dharti Patel
(74) *Attorney, Agent, or Firm* — NK Patent Law, PLLC

(57) ABSTRACT

A semi-wireless electric switch system controls power to electrical fixtures by multiplexing to remote solid state relays installed in the wiring junction of the fixtures. A mobile application is provided which may be downloaded and installed on the user's smartphone, tablet, laptop, or other electronic device. The application may be used to control the switch system. Wall switches are replaced by small flat-screen visual displays with touchscreen capability, which enable an installation technician to install additional lights, wall outlets, and other fixtures using existing wiring. Each relay has a preprogrammed three-digit code prefix, and receives and executes a simple digital command to turn on or turn off power to the fixture through the existing wiring.

14 Claims, 3 Drawing Sheets

SEMI-WIRELESS ELECTRIC SWITCH SYSTEM

CROSS-REFERENCE TO RELATED APPLICATIONS

This Application claims the benefit of U.S. Provisional Application No. 62/094,205, filed Dec. 19, 2014, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to residential and commercial electric components and in particular to a semi-wireless electric switch system. Due to the high cost of new construction, many existing homes and commercial buildings are being renovated and put to new uses. Unfortunately, modern lifestyles and business methods require many more lights and wall outlets than are generally found in older building designs. Installing additional wiring with the conduits and junction boxes required by current building codes is expensive, and may require the home buyer or building manager to cut back on plans.

A search of the prior art reveals various switch systems which have been developed to enable the use and control of an increased number of wiring circuits with an unchanged quantity of switches. None are closely related to the present invention, but several include features which resemble those of the present invention. Each has proven to be less than satisfactory in its own way. The present invention has been developed for the purpose of addressing and resolving these disadvantages.

Electronics for multipole remote operated relay, U.S. Pat. No. 7,889,476 (priority Sep. 22, 2006), provides an electrical distribution system for selectively connecting an electrical power source to load devices. The system comprises a panelboard having a plurality of load circuit positions. A remote operated relay is mountable in the panelboard in an adjacent pair of the load circuit positions comprising a multipole switching device, and a switch control for controlling the switching device, the switch control comprising a control circuit for operating the switching device responsive to control commands and a communication circuit for receiving control commands. An input/output (I/O) controller is mounted in the panelboard for controlling operation of the remote operated relay, the I/O controller comprising a programmed controller for generating the control commands for commanding operation of the remote operated relay. The control system also includes a communication circuit for communication with the remote operated relay communication circuit.

System controller for integrated lighting control panels, U.S. Pat. No. 8,018,089 (priority Sep. 22, 2006), provides an electrical distribution system for selectively connecting an electrical power source to load devices. The controller comprises a plurality of panelboards each having a plurality of load circuit positions. A plurality of pairs of circuit breakers and switching devices are each mounted in one of the load circuit positions. Each pair is electrically connected between an electrical power source and a load device for selectively delivering electrical power to load devices. An I/O controller is mounted in the panelboard for controlling operation of the switching devices. The I/O controller includes a communication circuit. A system controller is connected to each I/O controller communication circuit and comprises a programmed controller for commanding operation of the I/O controllers.

Configurable wall-mount touch screen switch, U.S. Patent App. Pub. No. US2011/0245940 (priority Apr. 1, 2010), provides a configurable wall mount light switch for use in controlling multiple light fixtures. In one embodiment, the switch includes a touch screen display, a transceiver and a programmable microcontroller. The microcontroller may be programmed to display a plurality of interface elements on the touch screen display for selection by a user to control one or more light fixtures. Typically, the switch is dimensioned to be received by a single gang electrical box.

Wireless electric switch device, Chinese Patent No. CN201859801 (priority Jul. 7, 2010) provides an electric switch device with a card reader. A card insertion port is arranged on the external side of the electric switch, and a signal-receiving/transmitting unit is arranged in the network node machine. The wireless signal integrates and processes various data through the network node machine, and the device is controlled by sending a signal to an executor. Electric power and wire connection material can be conserved effectively.

Linking sequence for wireless lighting control, U.S. Patent App. Pub. No. US 2010/207548 (priority Feb. 17, 2009) provides a method of linking one of a plurality of wireless switches to a transceiver and control for controlling an electric load. The sequence comprises the steps of moving the transceiver and control into a linking mode, and actuating at least one of the plurality of switches through an actuation mode that is distinct from a typical actuation of the switch to request a control operation, such as linking, by at least one of the transceivers and controls.

Generally, the prior art inventions have focused on the needs of new construction and failed to accommodate the needs of the renovation and remodeling trade. A semi-wireless electric switch system, which employs computer technology and remote relays to operate many more fixtures than conventional switches, would help to resolve this problem.

SUMMARY OF THE INVENTION

Accordingly, the invention is directed to a semi-wireless electric switch system. A mobile application is provided which may be downloaded and installed on the user's smartphone, tablet, laptop, or other electronic device. The application may be used to control the switch system. Wall switches are replaced by small flat-screen control modules with touchscreen capability, which enable an installation technician to install additional lights, wall outlets, and other fixtures using existing wiring. The application controls power to electrical fixtures by multiplexing to remote solid state relays installed in the wiring junction of the fixtures. A preprogrammed three-digit code prefix is provided for each relay. Thus each relay receives and executes a simple digital command to turn on or turn off power to the fixture through the existing wiring.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate one embodiment of the invention and, together with the description, serve to explain the principles of the invention.

DETAILED DESCRIPTION OF THE INVENTION

Figure 1:
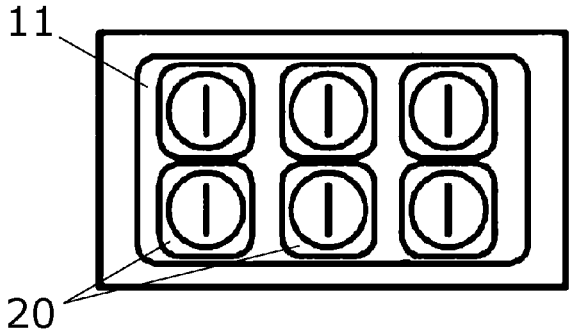
FIG. 1 is a front view of the control module 10 of the first exemplary embodiment, displaying the touchscreen display 11, and the switch icons 20.
Figure 2:
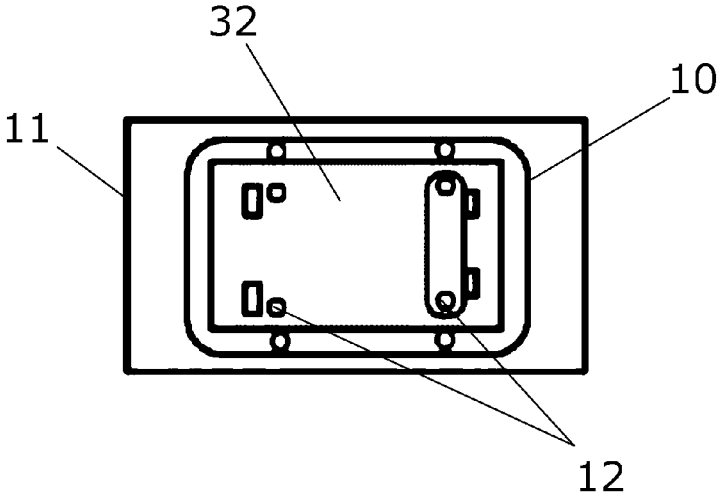
FIG. 2 is a rear view of the control module 10 of the first exemplary embodiment, displaying the wiring receptacles 12.
Figure 3:
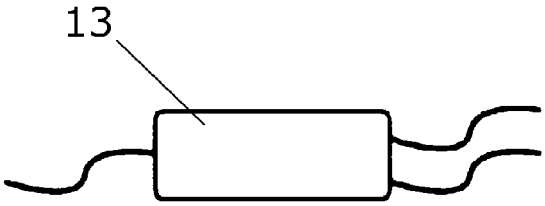
FIG. 3 is a side perspective view of the relay component of the first exemplary embodiment, displaying the relay 13.
Figure 4:
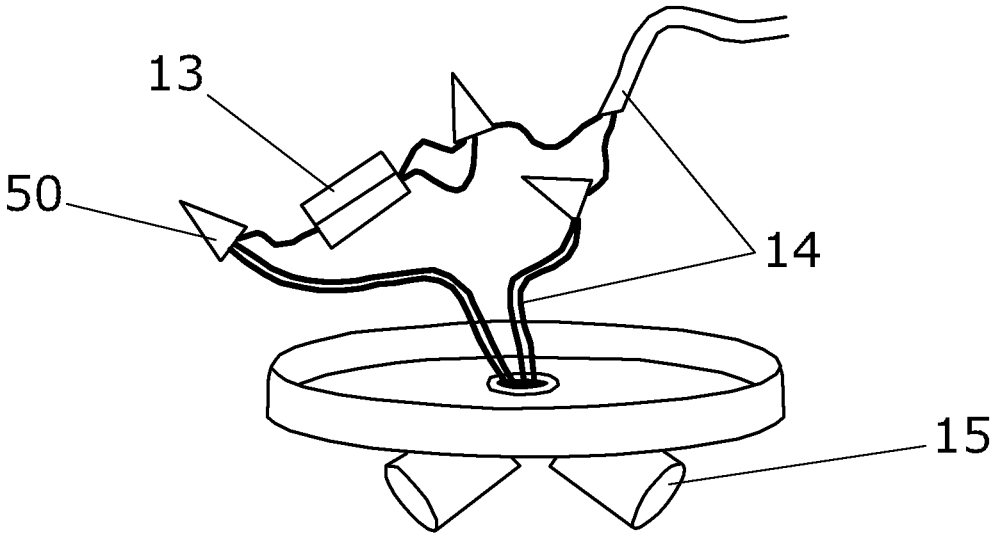
FIG. 4 is a side perspective view of the relay component 13 installed in the existing wiring 14 of a standard light 15.
Figure 5:
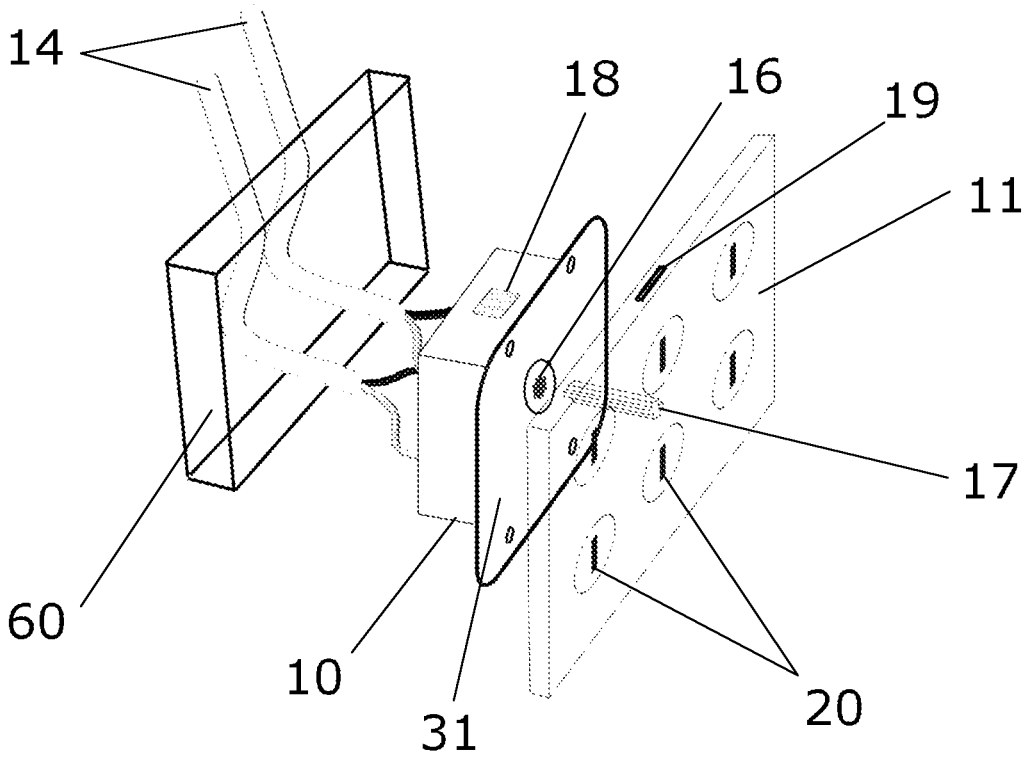
FIG. 5 is a blown up 3D perspective view of the switch system, displaying the touchscreen display 11 with male receptacle 17, the control module with female receptacle 16, the existing wiring 14, and the switch box 60.
Figure 6:
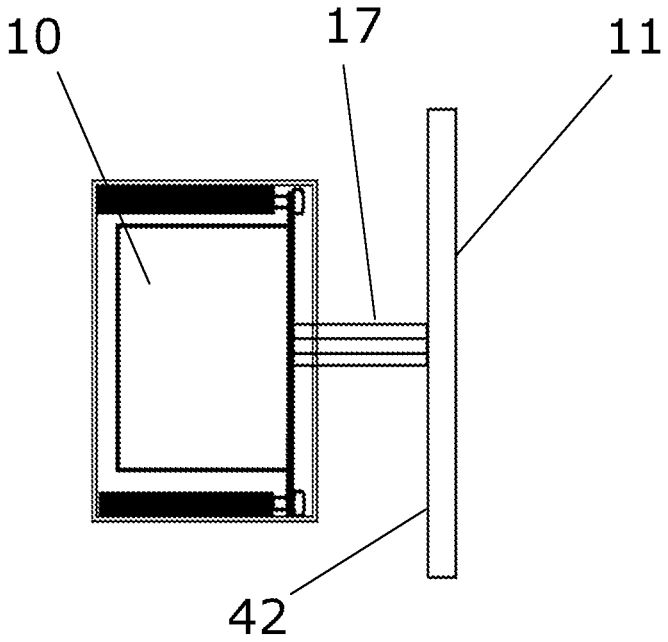
FIG. 6 is a blown up side view of the switch system, displaying the touchscreen 11 with male receptacle 17 being inserted into the control module 10.
Figure 7:
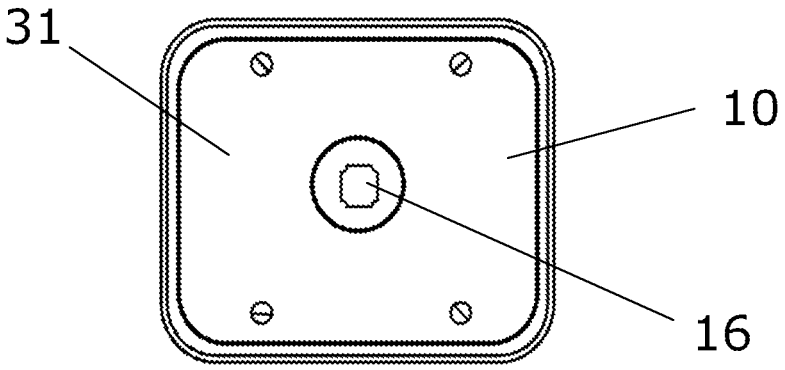
FIG. 7 is a front view of the control module 10, displaying the front surface 31 and female receptacle 16.

Referring now to the invention in more detail, the invention is directed to a semi-wireless electric switch system.

The first exemplary embodiment is comprised of a mobile application, one or more control module 10, and one or more relays 13. The application is provided on an Internet website operated by the controlling entity of the system and may be downloaded and installed on the user's smartphone, tablet, laptop computer, or other electronic device. The application may be used to control the switch system. Wall switches in the building are replaced by control modules 10 with touchscreen displays 11, which enables the installation of additional lights, wall outlets, and other fixtures using existing wiring. A switch icon 20 corresponding to each fixture appears on the control module 10.

The application controls power to the electrical fixtures by multiplexing to remote solid state relays 13 installed in the wiring junctions 14 of the respective fixtures. Each relay 13 has a preprogrammed three-digit code prefix, and receives and executes a simple digital command to turn on or turn off power to the fixture through the existing wiring 14.

Electronic components of the control module 10 preferably include a touchscreen monitor 11 with a power supply, a microprocessor, a memory device, a speaker, and a transmitter and receiver operating on any one of several long-range communications protocols, preferably WiFi™. Electronic components of the relay 13 preferably include a solid state relay, a receiver, and a preprogrammed control chip with a specific three-digit code prefix so as to operate only when a specific switch icon 20 is tapped on the touchscreen display 11.

Power is actually turned on and off at the relays 13. The control module 10 merely acts as the interface between the user and the relays 13, either by the touchscreen 11 or the application, by transmitting a signal one way in the direction of the relay 13 through the existing wiring 14, not backward toward the breaker panel. The control module 10 is designed to fit into existing standard switch boxes 60 and can independently control at least three times the fixtures as the standard switch. The control module attaches to the existing wiring 14 in the switch box 60 via the wiring receptacles 12 on the back surface 32 of the control module 10. The control module 10 provides a female receptacle 16 on its front surface 31 for the touchscreen 11 and can rotate five to ten degrees left or right to ensure that the screen is level. A small speaker 18 allows for an audible click feedback when setting up and turning fixtures on and off.

The touchscreen display 11 is designed with a male end 17 on its back surface 42 so as to insert into the control module 10. The touchscreen display 11 can be inserted part way, turned left or right to level it, and then pushed in and locked into place flush against the wall. On the top of the touchscreen display 11 is a slot 19 where a straight screwdriver can be inserted and when pressed, will release the touchscreen display 11 from the control module 10. The touchscreen display 11 itself is a simple touchscreen and allows the user to turn fixtures on and off using virtual switch icons 20, set up the system, add switch icons 20, change backgrounds and the appearance of the switch icons 20, and perform other options regarding the on and off times, home and away modes, and a night light function. The control module 10 is activated by tapping the touchscreen.

A dark screen option is provided, wherein the user can designate a particular fixture 15, such as a ceiling light, as the primary fixture 15 controlled by the control module 10. This enables the user to operate the primary fixture 15 in the dark, with the touchscreen display 11 deactivated. The user places the whole hand on the touchscreen display 11 and it will turn the primary fixture 15 on and activate the control module 10 for normal use. The control module 10 reads a large quantity of simultaneous taps, spread across a large portion of the touchscreen display 11, as the activation command.

The relays 13 can also turn on and off or dim as controlled from the user's electronic device, using the application. The relays 13 connect easily with standard twist connectors 50 where a fixture 15 is connected to the existing wiring 14, and are preferably designed to operate in a broad range of temperatures, such as −20° Fahrenheit to 140° Fahrenheit, to accommodate the wide range of temperatures in the fixtures 15 themselves, attic spaces, and refrigerated areas. Each code prefix corresponds to the number on the relay 13. Individual relays 13, touchscreen displays 11, and control modules 10 are available separately. Since the signal is sent onto the fixtures by the existing wires 14, there is no chance of the signal activating another relay 13 with the same three-digit prefix at another location in the building, since the signal is confined to the wiring 14 for the selected fixtures 15. In the event of power failure, the application will remember the last status.

To use the first exemplary embodiment, the user activates the application on an electronic device and follows the prompts provided. Individual fixtures 15 are turned on or off by clicking or tapping on the corresponding switch icon 20, either on the electronic device, or on the control module 10.

The control module 10 and the relay 13 are preferably manufactured from rigid, durable materials such as plastic, steel, aluminum alloy, brass, and copper alloy. Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A semi-wireless electric switch system, comprising:

a switch interface that includes:

a control module having computer executable code stored therein;

a display screen configured for receiving a selection from a user, the display screen being in communication with the control module;

a plurality of relays, each relay having an identifier, wherein, in operation, a respective relay is electrically coupled with a respective electronic fixture that is already installed within an existing electrical wiring of a structure, wherein each of the fixtures are electrically coupled to the switch interface through the existing electrical wiring, wherein, the computer executable code is configured to associate the received selection with the identifier in order to provide power to a selected relay in order to control the respective fixture.

2. The system of claim 1, wherein the switch interface is configured for communication with a mobile device, wherein the mobile device has computer executable code thereon for controlling the switch interface.

3. The system of claim 1, wherein each relay is installed in a wiring junction of a respective fixture, wherein the control module controls power to the electrical fixture by multiplexing a signal to said relay, and, in the event of power failure, the control module remembers a last status.

4. The system of claim 1, wherein a virtual switch icon corresponding to each fixture appears on the display screen.

5. The system of claim 1, wherein the identifier of each relay is a preprogrammed code prefix such that each code prefix corresponds to a respective relay, wherein the control module sends the code prefix through the existing wiring, wherein the relay responds to the code prefix by turning on power to the fixture if currently off, and turning off power to the fixture if currently on.

6. The system of claim 1, wherein electric power is turned on and off at the relays and the control module serves as the interface between the user and the relays, either by the display screen or an application executing the computer executable code, by transmitting a signal one way in the direction of the relay, not backward toward a breaker panel within the structure.

7. The system of claim 1, wherein the control module has a dimension that corresponds to a dimension of a standard switch box such that the control module is configured to fit into an existing standard switch box.

8. The system of claim 1, wherein the control module provides a female receptacle on a front surface for the display screen, and the female receptacle can rotate five to ten degrees left or right to ensure that the screen is level.

9. The system of claim 1, wherein the display screen is designed with a male receptacle on a back surface to insert into a female receptacle on the control module;

wherein the male receptacle is inserted part way, turned left or right to level it, and then pushed in and locked into place flush against a wall of the structure;

wherein on a top of the display screen is a slot where a straight screwdriver can be inserted and when pressed, will release the display screen from the control module.

10. The system of claim 1, further comprising a speaker that allows for an audible click feedback when setting up and turning fixtures on and off.

11. The system of claim 1, wherein the display screen is activated by tapping the display screen;

wherein the display screen allows the user to turn fixtures on and off using virtual switch icons, set up the system, add switch icons, change backgrounds and an appearance of the switch icons, and perform other options regarding the on and off times, home and away modes, and a night light function.

12. The system of claim 1, wherein a particular fixture is designated as a primary fixture, wherein the control module detects a repetition of simultaneous taps, spread across a large portion of the display screen, as a activation command such that a user may place a whole hand on the display screen to activate the primary fixture and the control module for normal use.

13. The switch system of claim 2, wherein the relays can also turn on and off or dim as controlled from the mobile device.

14. A method comprising:

installing a respective one of a plurality of relays in electrical communication with a respective one of a plurality of fixtures that are already installed within a structure;

installing a switch interface that includes:

a control module having computer executable code stored therein;

a display screen configured for receiving a selection from a user, the display screen being in communication with the control module;

associating an identifier with each of the relays;

wherein each of the fixtures are electrically coupled to the switch interface through existing electrical wiring of the structure, receiving a selection from a user of a fixture to turn on or off, wherein, the computer executable code is configured to associate the received selection with the identifier in order to provide power to a selected relay in order to control the respective fixture.

* * * * *